US012680720B2

(12) United States Patent
Nading et al.

(10) Patent No.: US 12,680,720 B2
(45) Date of Patent: Jul. 14, 2026

(54) SYSTEMS AND METHODS FOR MANAGING TEMPERATURE CONTROL IN AN INDOOR ENVIRONMENT

(71) Applicant: Carrier Corporation, Palm Beach Gardens, FL (US)

(72) Inventors: Charles Nading, Indianapolis, IN (US); Bradley Powell, Indianapolis, IN (US); Robert Smalley, Indianapolis, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 575 days.

(21) Appl. No.: 18/303,541

(22) Filed: Apr. 19, 2023

(65) Prior Publication Data

US 2024/0353141 A1 Oct. 24, 2024

(51) Int. Cl.

| | |
|---|---|
| ***F24F 11/00*** | (2018.01) |
| ***F24F 11/38*** | (2018.01) |
| ***F24F 11/52*** | (2018.01) |
| ***F24F 11/80*** | (2018.01) |
| ***F24F 13/00*** | (2006.01) |
| ***F24F 13/10*** | (2006.01) |
| *F24F 110/10* | (2018.01) |
| *F24F 120/20* | (2018.01) |

(52) U.S. Cl.

CPC ..... *F24F 11/80* (2018.01); *F24F 11/38* (2018.01); *F24F 11/52* (2018.01); *F24F 13/10* (2013.01); *F24F 2110/10* (2018.01); *F24F 2120/20* (2018.01)

(58) Field of Classification Search

CPC .. F24F 11/38; F24F 11/52; F24F 11/80; F24F 13/10

See application file for complete search history.

(56) References Cited

U.S. PATENT DOCUMENTS

| | | | | |
|---|---|---|---|---|
| 5,289,362 | A | 2/1994 | Liebl et al. | |
| 5,909,378 | A * | 6/1999 | De Milleville .... | G05D 23/1904 236/47 |
| 5,924,486 | A | 7/1999 | Ehlers et al. | |
| 6,064,310 | A | 5/2000 | Busak et al. | |
| 7,225,054 | B2 | 5/2007 | Amundson et al. | |
| 7,516,106 | B2 | 4/2009 | Ehlers et al. | |
| 7,775,454 | B2 | 8/2010 | Mueller et al. | |
| 8,032,254 | B2 | 10/2011 | Amundson et al. | |

(Continued)

*Primary Examiner* — Mark A Connolly

(74) *Attorney, Agent, or Firm* — Souad Hakim

(57) ABSTRACT

Embodiments of the disclosure describe systems and methods for managing temperature control in an indoor environment, having a plurality of zones, by a Heating Ventilation, and Air Conditioning (HVAC) system. The method comprises, for each zone, detecting a current temperature value of a corresponding zone, comparing the current temperature value with one of a first threshold value and a second threshold value for the corresponding zone, and determining, based on the comparison, whether the current temperature value reaches one of the first threshold value or the second threshold value, and in response to the determination, triggering one of a first control action or a second control action for the corresponding zone. The second threshold value is one of greater than or less than the first threshold value and a set point range for the corresponding zone when one of heating or cooling is being performed by the HVAC system.

18 Claims, 5 Drawing Sheets

(56) References Cited

U.S. PATENT DOCUMENTS

| | | | | |
|---|---|---|---|---|
| 8,219,249 | B2 | 7/2012 | Harrod et al. | |
| 8,433,446 | B2 | 4/2013 | Grohman et al. | |
| 8,560,127 | B2 | 10/2013 | Leen et al. | |
| 9,002,523 | B2 | 4/2015 | Erickson et al. | |
| 9,157,646 | B2 | 10/2015 | Anderson et al. | |
| 10,175,668 | B2 | 1/2019 | Fadell et al. | |
| 10,234,156 | B2 | 3/2019 | Dempsey et al. | |
| 10,760,806 | B1 * | 9/2020 | White | F24F 11/30 |
| 11,365,898 | B1 * | 6/2022 | Smith | F24F 11/38 |
| 2007/0203860 | A1 | 8/2007 | Golden et al. | |
| 2008/0217419 | A1 | 9/2008 | Ehlers et al. | |
| 2011/0031322 | A1 * | 2/2011 | Zou | F24F 3/0442 236/1 B |
| 2020/0033018 | A1 * | 1/2020 | Nabeshima | F24F 1/14 |
| 2023/0013263 | A1 * | 1/2023 | Kewekordes, II | F24H 15/174 |
| 2024/0003579 | A1 * | 1/2024 | Tsuji | F24F 11/65 |

* cited by examiner

SYSTEMS AND METHODS FOR MANAGING TEMPERATURE CONTROL IN AN INDOOR ENVIRONMENT

FIELD OF THE INVENTION

The disclosure generally relates to Heating Ventilation and Air Conditioning (HVAC) systems, and more particularly relates to systems and methods for managing temperature control in an indoor environment.

BACKGROUND

HVAC Heating Ventilation and Air Conditioning (HVAC) units are installed in a residential, commercial, or an industrial building. The HVAC units maintain temperature and provide proper airflow within the building. The HVAC units may provide heated or cooled air within the building to adjust the temperature therewithin. The heating and cooling requirements that the HVAC units operate to meet may be determined by the users within the building. For instance, a user may want to increase the temperature within the building, and accordingly, the HVAC units may operate to provide heated airflow within the building.

Currently, the HVAC units operate based on the requirements of the users in the building where the HVAC units are installed. That is, the HVAC units operate to increase or decrease the temperature within the building based on user requirements.

In case there is a hardware and/or a software issue with the HVAC units, or with some particular components of the HVAC units, the HVAC units may continue to operate based on the user requirements. As an example, the user may desire to increase the temperature within the building to a particular value, however, because of the hardware and/or software issue, the HVAC units may continue to increase the temperature within the building beyond the particular value. Similarly, in case the cooling is desired, the HVAC units may continue to decrease the temperature below a particular desired value.

Thus, the HVAC units continue to operate even with the hardware and/or software issues. A user may not be aware of the hardware and/or software issues during the operation of the HVAC units. With the continued operation, the temperature and living conditions within the building may become uncomfortable for the users. For instance, the temperature within the building may approach extreme values with the continued operation of the HVAC units having the hardware and/or software issues.

Therefore, it would be advantageous to provide a solution that can overcome the above-discussed problems.

SUMMARY

This summary is provided to introduce a selection of concepts, in a simplified format, that are further described in the detailed description of the disclosure. This summary is neither intended to identify key or essential inventive concepts of the disclosure and nor is it intended for determining the scope of the disclosure.

Disclosed herein is a method for managing temperature control in an indoor environment by a Heating Ventilation and Air Conditioning (HVAC) system. The indoor environment includes a plurality of zones. For each of the plurality of zones, the method comprises detecting a current temperature value of a corresponding zone of the plurality of zones. The method further comprises comparing the current temperature value with one of a first threshold value and a second threshold value for the corresponding zone. The method further comprises determining, based on the comparison, whether the current temperature value reaches one of the first threshold value or the second threshold value. Furthermore, in response to the determination that the current temperature value reaches one of the first threshold value or the second threshold value, the method comprises triggering one of a first control action or a second control action for the corresponding zone. The second threshold value is one of greater than or less than the first threshold value and a set point range for the corresponding zone when one of heating or cooling is being performed by the HVAC system.

In one or more embodiments, when the heating is performed, the first threshold value is greater than the corresponding set point range, and the second threshold value is greater than the first threshold value.

In one or more embodiments, when the cooling is performed, the first threshold value is less than the corresponding set point range, and the second threshold value is less than the first threshold value.

In one or more embodiments, the method may further comprise receiving, from a user associated with the corresponding zone, a user input corresponding to one of heating or cooling of the corresponding zone. The current temperature value of the corresponding zone is detected based on the reception of the user input.

In one or more embodiments, the method may further comprise maintaining, at the corresponding zone, the current temperature value within the set point range based on the received user input.

In one or more embodiments, the triggering of the first control action for the corresponding zone comprises controlling a movement of a damper mechanism of the HVAC system associated with the corresponding zone to close a damper.

In one or more embodiments, when the first control action is triggered, the method may further comprise generating a first alert notification on a graphical user interface (GUI) associated with the HVAC system. The first alert notification is indicative of a malfunction within the corresponding zone.

In one or more embodiments, the triggering of the second control action for the corresponding zone comprises a controlling operation of the HVAC system to cease the heating or cooling for each zone of the plurality of zones and generate a second alert notification on a graphical user interface (GUI) associated with the HVAC system. The second alert notification is indicative of a malfunction within the corresponding zone.

In one or more embodiments, the current temperature value of the corresponding zone is detected by one or more temperature sensors of the HVAC system. The one or more temperature sensors are installed within the corresponding zone of the plurality of zones.

Also disclosed herein is a Heating Ventilation and Air Conditioning (HVAC) system to manage temperature control in an indoor environment. The indoor environment includes a plurality of zones. The HVAC system comprises at least one HVAC equipment and at least one control device communicatively connected with the at least one HVAC equipment. The at least one control device comprises one or more processors. For each of the plurality of zones, the one or more processors are configured to detect a current temperature value of a corresponding zone of the plurality of zones. The one or more processors are further configured to compare the current temperature value with one of a first threshold value and a second threshold value for the corresponding zone. The one or more processors are further configured to determine, based on the comparison, whether the current temperature value reaches one of the first threshold value or the second threshold value. In response to the determination that the current temperature value reaches one of the first threshold value or the second threshold value, the one or more processors are further configured to trigger one of a first control action or a second control action for the corresponding zone. The second threshold value is one of greater than or less than the first threshold value and a set point range for the corresponding zone when one of heating or cooling is being performed by the HVAC system.

In one or more embodiments, when the heating is performed, the first threshold value is greater than the corresponding set point range, and the second threshold value is greater than the first threshold value.

In one or more embodiments, when the cooling is performed, the first threshold value is less than the corresponding set point range, and the second threshold value is less than the first threshold value.

In one or more embodiments, the one or more processors are further configured to receive, from a user associated with the corresponding zone, a user input corresponding to one of heating or cooling of the corresponding zone. The current temperature value of the corresponding zone is detected based on the reception of the user input.

In one or more embodiments, the one or more processors are further configured to maintain, at the corresponding zone, the current temperature value within the set point range based on the received user input.

In one or more embodiments, to trigger the first control action for the corresponding zone, the one or more processors are configured to control a movement of a damper mechanism of the HVAC system associated with the corresponding zone to close a damper.

In one or more embodiments, when the first control action is triggered, the one or more processors are further configured to generate a first alert notification on a graphical user interface (GUI) associated with the HVAC system. The first alert notification is indicative of a malfunction within the corresponding zone.

In one or more embodiments, to trigger the second control action for the corresponding zone, the one or more processors may be configured to control an operation of the HVAC system to cease the heating or cooling for each zone of the plurality of zones, and may generate a second alert notification on a graphical user interface (GUI) associated with the HVAC system. The second alert notification is indicative of a malfunction within the corresponding zone.

In one or more embodiments, the current temperature value of the corresponding zone is detected by one or more temperature sensors of the HVAC system, and the one or more temperature sensors are installed within the corresponding zone of the plurality of zones.

To further clarify the advantages and features of the methods, systems, and apparatuses, a more particular description of the methods, systems, and apparatuses will be rendered by reference to specific embodiments thereof, which are illustrated in the appended drawings. It is appreciated that these drawings depict only typical embodiments of the disclosure and are therefore not to be considered limiting of its scope. The disclosure will be described and explained with additional specificity and detail with the accompanying drawings.

BRIEF DESCRIPTION OF THE DRAWINGS

These and other features, aspects, and advantages of the disclosure will become better understood when the following detailed description is read with reference to the accompanying drawings in which like characters represent like parts throughout the drawings, wherein.

Figure 1:
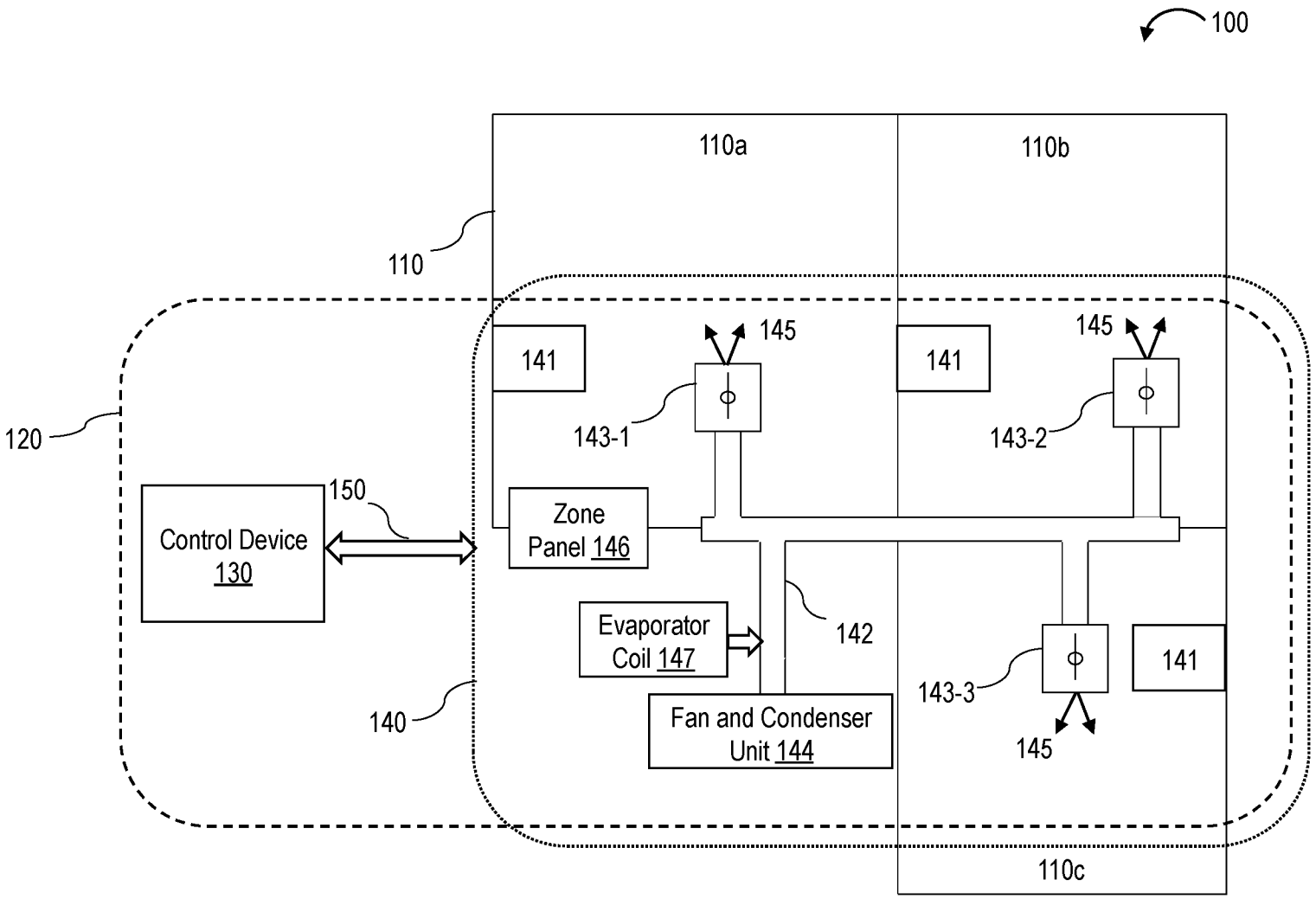
FIG. 1 illustrates a system environment for managing temperature control in an indoor area/environment by an HVAC system.

Further, skilled artisans will appreciate that elements in the drawings are illustrated for simplicity and may not have necessarily been drawn to scale. For example, the flow charts illustrate the method in terms of the most prominent steps involved to help to improve understanding of aspects of the disclosure. Furthermore, in terms of the construction of the device, one or more components of the device may have been represented in the drawings by conventional symbols, and the drawings may show only those specific details that are pertinent to understanding the embodiments of the disclosure so as not to obscure the drawings with details that will be readily apparent to those of ordinary skill in the art having the benefit of the description herein.

DETAILED DESCRIPTION

For the purpose of promoting an understanding of the principles of the disclosure, reference will now be made to the various embodiments and specific language will be used to describe the same. It will nevertheless be understood that no limitation of the scope of the disclosure is thereby intended, such alterations and further modifications in the illustrated system, and such further applications of the principles of the disclosure as illustrated therein being contemplated as would normally occur to one skilled in the art to which the disclosure relates.

It will be understood by those skilled in the art that the foregoing general description and the following detailed description are explanatory of the disclosure and are not intended to be restrictive thereof.

Reference throughout this specification to "an aspect", "another aspect" or similar language means that a particular feature, structure, or characteristic described in connection with the embodiment is included in at least one embodiment of the disclosure. Thus, appearances of the phrase "in an embodiment", "in another embodiment", "some embodiments", "one or more embodiments" and similar language throughout this specification may but do not necessarily, all refer to the same embodiment.

The terms "comprises", "comprising", or any other variations thereof, are intended to cover a non-exclusive inclusion, such that a process or method that comprises a list of steps does not include only those steps but may include other steps not expressly listed or inherent to such process or method. Similarly, one or more devices or sub-systems or elements or structures or components proceeded by "comprises . . . a" does not, without more constraints, preclude the existence of other devices or other sub-systems or other elements or other structures or other components or additional devices or additional sub-systems or additional elements or additional structures or additional components.

In addition to overcoming the challenges related to continued operation with hardware and/or software errors and over-conditioning of the indoor environment, the disclosure provides for an HVAC system that alerts the users, such as homeowners, dealers, and administrators, regarding possible malfunctions and errors. For instance, the HVAC system may alert the users when the temperature of the indoor environment is heading to an extreme value that would be uncomfortable for the users. Further, the HVAC system reacts to the over-conditioning, in that, the HVAC system is configured to take action to prevent further heating or cooling of certain areas within the indoor environment. Moreover, in case of extreme conditions in one or more areas within the indoor environment, the HVAC system may take action to shut down the entire system and cease heating or cooling of the indoor environment. Thus, an additional safety layer is achieved by the HVAC system.

Embodiments of the disclosure will be described below in detail with reference to the accompanying drawings.

FIG. 1 illustrates a system environment 100 for managing temperature control in an indoor area/environment.

The system environment 100 may include an indoor area/environment 110. The system environment 100 may include an HVAC system 120 comprising a control device 130 and an HVAC equipment 140. In an embodiment, the control device 130 may be in communication with one or more components of the HVAC equipment 140, as discussed below herein throughout the disclosure.

The indoor environment 110 may relate to an indoor environment of a residential or commercial property. The indoor environment 110 may comprise a plurality of zones 110*a* to 110*c* as shown in FIG. 1. The respective zones of the plurality of zones 110*a* to 110*c* may correspond to, but not limited to, a living room area, a bedroom, a family room, a conference room, a garage, a kitchen, and the like. Zones 110*a*, 110*b*, and 110*c* as shown in FIG. 1 are non-limiting in scope and exemplary. A person skilled in the art would understand that the system environment 100 may include other zones as well, without deviating from the scope of the disclosure.

The HVAC equipment 140 may comprise a plurality of temperature sensors 141 disposed in the indoor environment 110. In an embodiment, a corresponding temperature sensor among the plurality of temperature sensors may be disposed in each of the plurality of zones 110*a* to 110*c*. That is, each of the plurality of zones 110*a* to 110*c* may comprise a corresponding temperature sensor 141 of the plurality of temperature sensors 141. In one or more embodiments, the plurality of temperature sensors 141 may be configured to sense temperature within the corresponding zones. In one embodiment, the plurality of temperature sensors 141 may comprise, but not limited to, thermistors, Resistance Temperature Detectors (RTDs), thermocouples, Infrared sensors, and any other temperature sensor. The RTDs may sense ambient air temperature in the indoor environment 110.

The HVAC equipment 140 may further comprise a ductwork arrangement 142 disposed in the indoor environment 110, the ductwork arrangement 142 may be configured to allow the flow of conditioned air therethrough. The ductwork arrangement 142 may be disposed in the indoor environment 110 so as to provide conditioned air to each of the plurality of zones 110*a* to 110*c*. In an embodiment, the ductwork arrangement 142 may comprise a central duct and a plurality of extension ducts extending from the central duct. The plurality of extension ducts may extend to the corresponding zones of the plurality of zones 110*a* to 110*c*, thereby providing the conditioned air to the corresponding zones.

The HVAC equipment 140 may further comprise one or more dampers 143-1 to 143-3. Each of the dampers 143-1 to 143-3 may be configured to adjust the flow of conditioned air to the indoor environment 110. In an embodiment, each of the plurality of zones 110*a* to 110*c* may be associated with a corresponding damper of the one or more dampers 143-1 to 143-3 such that the corresponding dampers adjust the flow of conditioned air to the associated zone. In an embodiment, the one or more dampers 143-1 to 143-3 may be associated with a damper mechanism that may be configured to mechanically move or adjust the corresponding dampers 143-1 to 143-3. In an embodiment, the damper mechanism may be movable to open and/or close the corresponding dampers 143-1 to 143-3.

The HVAC equipment 140 may further comprise a fan and condenser unit 144, and an evaporator coil 147 coupled to the ductwork arrangement 142. The fan and condenser unit 144 may be configured to circulate conditioned air through the ductwork arrangement 142. As can be seen in FIG. 1, conditioned air 145 may flow through the ductwork arrangement 142 to each of the plurality of zones 110*a* to 110*c*. The evaporator coil 147 may absorb heat from conditioned air that passes through the ductwork arrangement 142 and then cools the conditioned air and removes moisture from the conditioned air.

The HVAC equipment 140 may further comprise a zone panel 146. The zone panel 146 may be communicatively coupled to the plurality of temperature sensors 141 and the one or more dampers 143-1 to 143-3. In an embodiment, the zone panel 146 may be configured to provide power to the one or more dampers 143-1 to 143-3 and/or the plurality of temperature sensors 141. In an embodiment, the zone panel 146 may be coupled to the one or more temperature sensors 141 in a wired manner. In an embodiment, the zone panel 146 may be further coupled to the one or more dampers 143-1 to 143-3 in the wired manner.

In one or more embodiments, one or more components of the HVAC equipment 140 may be communicatively coupled to the control device 130 via a communication network 150. For instance, in one embodiment, the zone panel 146 may be in communication with the control device 130. The zone panel 146 may receive readings from the temperature sensors 141 and may provide the readings to the control device 130. The zone panel 146 may receive control commands from the control device 130 and control movement of the dampers 143-1 to 143-3 based on the control commands. In another embodiment, the one or more temperature sensors 141 may be in direct communication with the control device 130 so as to send readings indicative of the temperature of the corresponding zone directly to the control device 130. Further, in an embodiment, the fan and condenser unit 144 may be in communication with the control device 130.

Figure 2:
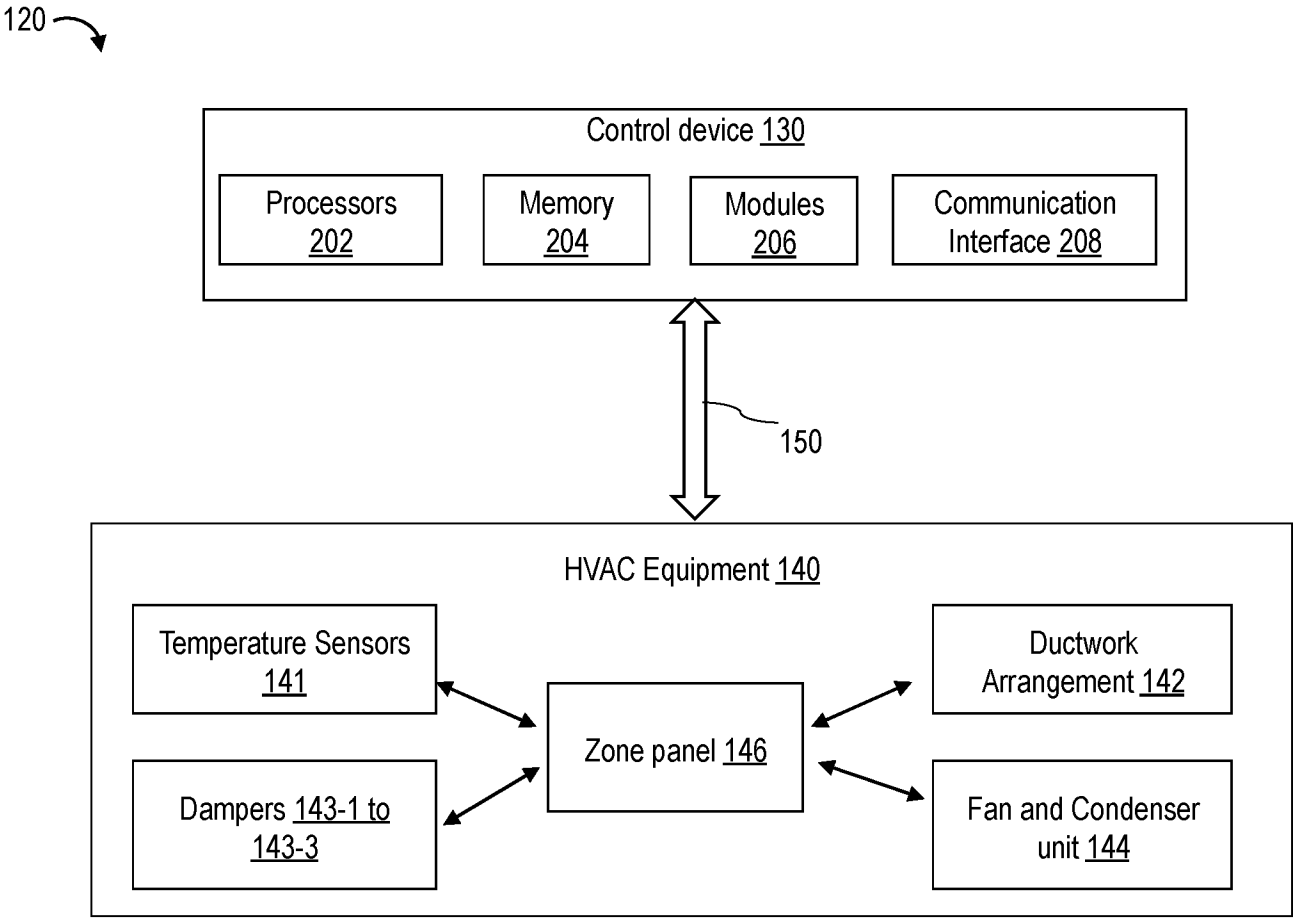
FIG. 2 illustrates a schematic block diagram of the HVAC system for managing temperature control in the indoor environment.

FIG. 2 illustrates a schematic block diagram of the HVAC system 120 for managing temperature control in the indoor environment 110.

As shown in FIG. 2, the control device 130 is in communication with one or more components of the HVAC equipment 140. In one or more embodiments, the control device 130 may comprise one or more processors 202, a memory 204, one or more modules 206, and a communication interface 208.

The one or more processors 202 may be configured to communicate with the memory 204 to store temperature related data, such as received readings from the temperature sensors 141, for managing the temperature control. In one or more embodiments, the one or more processors 202 may be one or more microprocessor(s) or microcontroller(s). The one or more processors 202 may include one or a plurality of processors, may include one or more general-purpose processors, such as a central processing unit (CPU), an application processor (AP), or the like, a graphics-only processing unit such as a graphics processing unit (GPU), a visual processing unit (VPU), and/or an Artificial intelligence (AI) dedicated processor such as a neural processing unit (NPU).

In some embodiments, the memory 204 may store data and instructions executable by the processor(s) 202 to perform the method steps for managing temperature control in the indoor environment 110, as discussed herein throughout the disclosure. The memory 204 may further include, but not limited to, a non-transitory computer-readable storage media such as various types of volatile and non-volatile storage media, including but not limited to, random access memory, read-only memory, programmable read-only memory, electrically programmable read-only memory, electrically erasable read-only memory, flash memory, magnetic tape or disk, optical media and the like. Further, the non-transitory computer-readable storage media of the memory 204 may include executable instructions in a form of the modules 206 and a database to store data. The modules 206 may include a set of instructions that may be executed to cause the one or more processors 202 to perform any one or more of the methods managing temperature control in an indoor environment, as disclosed herein throughout the disclosure. Specifically, the one or more modules 206 may be configured to perform the steps of the disclosure using the data stored in the database of the memory 204 for managing temperature control in an indoor environment. In another embodiment, the modules 206 may be one or more hardware units that may be outside the memory 204. In one embodiment, the memory 204 may communicate via a bus within the processor(s) 202.

In one or more embodiments, the communication interface 208 may include a transmitter and a receiver, and may be configured to communicate with one or more components of the HVAC equipment 140, such as the zone panel 146, the plurality of temperature sensors 141, and/or the fan and condenser unit 144, via the communication network 150. The communication via the communication network 150 may be based on a wireless communication protocol. The communication interface 208 coupled with the one or more processors 202 may be configured to transmit an alert indicating malfunctioning of the HVAC equipment within one or more zones of the plurality of zones 110*a* to 110*c*. The communication interface 208 may be configured for communicating internally between internal hardware components and with external devices, e.g., the HVAC equipment 140, via one or more networks (e.g., radio technology). The communication interface 208 may include an electronic circuit specific to a standard that may enable wireless communication.

Referring to FIGS. 1 and 2, the one or more processors 202 may be configured to manage temperature control in the indoor environment 110. In one or more embodiments, the one or more processors 202 may be configured to manage temperature control in each of the plurality of zones 110*a* to 110*c*, within the indoor environment 110. The one or more processors 202 may be further configured to detect a current temperature value of a corresponding zone of the plurality of zones 110*a* to 110*c*. The one or more processors 202 may be further configured to process the readings received from the temperature sensor 141 of the corresponding zone in order to detect the current temperature value of the corresponding zones.

The current temperature value may be indicative of an actual temperature within the corresponding zone that is being sensed by the temperature sensor 141 installed in the corresponding zones. For instance, considering zones 110*a* to 110*c*, the current temperature value of the zone 110*a* may be the actual temperature of the zone 110*a* that is detected by the temperature sensor 141 installed within the zone 110*a*.

In an embodiment, for each of the plurality of zones 110*a* to 110*c*, one or more temperature set point ranges may be stored in the memory 204. The HVAC equipment 140 may be configured to maintain the actual temperature of the corresponding zones within the set point range based on the readings of the temperature sensor 141 installed within the corresponding zones.

In an embodiment, set point ranges for one of the plurality of zones 110*a* to 110*c* may be different from set point ranges for another zone among the plurality of zones 110*a* to 110*c*. In an embodiment, the set point range may be selected to be in a range between 50° F. to 88° F. for heating and the set point range may be selected to be in a range between 52° F. to 90° F. for cooling. For instance, the set point range for zone 110*a* may be set as 70-71° F., and the HVAC equipment 140 may be configured to maintain the temperature for zone 110*a* at 70-71° F. In case the actual temperature of zone 110*a* is 65° F. as sensed by the temperature sensor 141, the HVAC equipment 140 may provide conditioned air to the zone 110*a* to increase the temperature to the set point range.

In an embodiment, for each of the plurality of zones 110*a* to 110*c*, threshold temperature values may be stored in the memory 204. In particular, a first threshold value and a second threshold value may be stored in the memory 204. The one or more processors 202 may be further configured to compare the current temperature value of the corresponding zones with one of the first threshold value and the second threshold value.

In an embodiment, the HVAC system 120 may be configured to operate in a heating mode and a cooling mode. In the heating mode, the HVAC system 120 may provide conditioned air to heat the indoor environment 110. In the cooling mode, the HVAC system 120 may provide conditioned air to cool the indoor environment 110.

In an embodiment, the one or more processors 202 may be configured to operate in the heating mode or the cooling mode based on a user input. The one or more processors 202 may be configured to receive the user input corresponding to one of the heating or cooling of the corresponding zone. The user input may correspond to an input provided by a user of the HVAC system 120. The input may correspond to a selection of a heating operation or a cooling operation for heating or cooling the corresponding zones. Based on the reception of the user input, the one or more processors 202 may be configured to maintain the actual temperature within the set point range for the corresponding zone. Further, the one or more processors 202 may be configured to detect the current temperature value and compare the current temperature value with one of the first threshold value or the second threshold value based on the received user input. In an embodiment, the user input may be received via a user device, such as a smart phone, a remote device, or a pre-installed device within the corresponding zones, such as a thermostat or a smart sensing device.

When the HVAC system 120 is being operated in the heating mode, i.e., when heating of the indoor environment is being performed, the first threshold value for a corresponding zone may be greater than the set point range for the corresponding zone. Further, the second threshold value for the corresponding zones may be greater than the first threshold value. As an example, the set point range for the zone 110*a* may be 70-71° F., the first threshold value may be 78° F., and the second threshold value may be 90° F. Accordingly, when heating is performed by the HVAC system 120 for a corresponding zone among the plurality of zones 110*a* to 110*c*, the second threshold value may be greater than the first threshold value and the set point range.

When the HVAC system 120 is being operated in the cooling mode, i.e., when cooling of the indoor environment is being performed, the first threshold value for a corresponding zone may be less than the set point range for the corresponding zone. Further, the second threshold value for the corresponding zones may be less than the first threshold value. As an example, the set point range for zone 110*a* may be 70-71° F., the first threshold value may be 62° F., and the second threshold value may be 50° F. Accordingly, when cooling is performed by the HVAC system 120 for a corresponding zone among the plurality of zones 110*a* to 110*c*, the second threshold value may be less than the first threshold value and the set point range.

The one or more processors 202 may be further configured to determine whether the current temperature value of the corresponding zone reaches one of the first threshold value or the second threshold value. For instance, in the heating mode, when the current temperature value is less than the first threshold value, the one or more processors 202 may be further configured to determine whether the current temperature value reaches the first threshold value. The one or more processors 202 may be further configured to trigger a first control action for the corresponding zones in response to the determination that the current temperature value reaches the first threshold value.

In one or more embodiments, the first control action may relate to a controlling movement of the damper mechanism associated with the one or more dampers 143-1 to 143-3 that are installed within the corresponding zones, respectively. As described above herein, each of the plurality of zones 110*a* to 110*c* may be provided with conditioned air via the ductwork arrangement 142 and the one or more dampers 143-1 to 143-3 may be installed to control the flow of air into the corresponding zone of the plurality of zones 110*a* to 110*c*. The one or more processors 202 may be further configured to control the movement of the damper mechanism to close the damper, for example, one of the dampers among the one or more dampers 143-1 to 143-3, and restricts the flow of the air into the corresponding zones where the damper is installed. Accordingly, in response to the determination that the current temperature value of the corresponding zones reaches the first threshold value, the one or more processors 202 may be further configured to trigger the first control action to cause the damper within the corresponding zone to be closed.

In one or more embodiments, the one or more processors 202 may be further configured to generate a first alert notification when the first control action is triggered. The first alert notification may be displayed on a graphical user interface (GUI) associated with the HVAC system 120. For instance, the HVAC system 120 may comprise a thermostat and/or a smart sensor device installed within each of the plurality of zones 110*a* to 110*c*, and for the corresponding zones, the first alert notification may be displayed by the thermostat. In one or more embodiments, the first alert notification may be indicative of a malfunction within a corresponding zone among the plurality of zones 110*a* to 110*c*. For instance, the first alert notification may comprise information related to error codes and error messages that allows the user within the corresponding zone to be aware of possible malfunction scenarios. In a non-limiting example, if there is only one zone or no dampers are available in the HVAC equipment 140, error code may be displayed as 140 indicating a system monitor alert. Further, if the malfunction is happened in Zone 110*a* a fault error code 141 would be displayed. Similarly, If the malfunction is happened in Zone 110*b* a fault error code 142 would be displayed and so on.

In an embodiment, in the heating mode, when the current temperature value is greater than the first threshold value and less than the second threshold value, the one or more processors 202 may be configured to determine whether the current temperature value reaches the second threshold value. The one or more processors 202 may be further configured to trigger a second control action for the corresponding zones in response to the determination that the current temperature value reaches the second threshold value.

In an embodiment, the one or more processors 202 may be configured to automatically monitor a change in the current temperature value for one of the heating or cooling of a particular zone among zones 110*a* to 110*c*. The one or more processors 202 may be further configured to determine whether the current temperature value reaches the first threshold value for the particular zone based on the monitoring of the change in the current temperature value. The one or more processors 202 may be further configured to trigger, in response to the determination that the current temperature value reaches the first threshold value, the first control action for the particular zone for which the current temperature value reaches the first threshold value. In a non-limiting example, in heating, if there is a heating call received from the zone 110*a* and the one or more processors 202 detects that the actual temperature of the zone 110*a* reaches the first threshold value, then the one or more processors 202 may trigger the first control action for the zone 110*a*. In another non-limiting example, in heating, if there is no any heating call received from the zone 110*a* and the one or more processors 202 detects that the actual temperature of the zone 110*a* reaches the first threshold value, then the one or more processors 202 may not trigger the first control action for the zone 110*a*.

In an embodiment, the second control action relates to shutting down the HVAC equipment 140 of the HVAC system 120. The one or more processors 202 may be configured to control the operation of the HVAC system 120 to cease or shut down the HVAC equipment 140. As a result, the heating for the entire indoor environment 110 is ceased. That is, for all of the plurality of zones 110*a* to 110*c*, the heating by the HVAC equipment 140 may be ceased when the one or more processors 202 determines that the current temperature value reaches the second threshold value.

Accordingly, in response to the determination that the current temperature value of the corresponding zone reaches the second threshold value, the one or more processors 202 may be configured to trigger the second control action to cease the heating operation for each zone of the plurality of zones 110*a* to 110*c*.

In one or more embodiments, the one or more processors 202 may be configured to generate a second alert notification when the second control action is triggered. The second alert notification may be displayed on a graphical user interface (GUI) associated with the HVAC system 120. As described above, the HVAC system 120 may comprise a thermostat and/or a smart sensor device installed within each of the plurality of zones 110*a* to 110*c* and the second alert notification may be displayed at the thermostat. In one or more embodiments, the second alert notification may be indicative of a malfunction within the corresponding zone where the current temperature reached the second threshold value. For instance, the second alert notification may comprise information related to error codes and error messages that allows the user within the corresponding zone to be aware of possible malfunction scenarios.

In one or more embodiments, the current temperature value for the corresponding zones may reach the first threshold value and/or the second threshold value because of certain hardware malfunctions and/or software malfunctions. For instance, a hardware malfunction may be associated with the one or more dampers 143-1 to 143-3 associated with the corresponding zones such that the one or more dampers 143-1 to 143-3 may not properly restrict the flow of conditioned air 145 into the corresponding zones. Further, a software malfunction may be associated with software error such that the one or more processors 202 may not accurately determine the temperature readings, damper open/close status, user inputs or heating or cooling, and the like.

Although the triggering of the first and second control actions are described with reference to the HVAC system 120 being operated in the heating mode, the one or more processors 202 may be further configured to trigger the first and second control actions when the HVAC system 120 is operated in the cooling mode. For instance, in the cooling mode, when the current temperature value is greater than the first threshold value, the one or more processors 202 may further determine whether the current temperature value reaches the first threshold value and may trigger the first control action upon determining that the current temperature value reaches the first threshold value. Further, when the current temperature value is less than the first threshold value and greater than the second threshold value, the one or more processors 202 may determine whether the current temperature value reaches the second threshold value and may trigger the second control action upon determining that the current temperature value reaches the second threshold value.

Referring to Tables 1-4 as shown below herein, various exemplary use-case scenarios of the HVAC system 120 to manage temperature control in the indoor environment are provided. The exemplary scenarios shown below relate to the operation of the HVAC system 120 in the heating mode.

As can be seen in Table 1, the HVAC system 120 maintains the current temperature of the corresponding zones to the set points. The damper status the corresponding zones may be open so that each of the zones 110*a*, 110*b*, and 110*c* are maintained at the set point.

TABLE 1

| | Set Point | Current Temperature Value | Damper Status |
|---|---|---|---|
| Zone 110a | 70 | 70 | Open |
| Zone 110b | 71 | 71 | Open |
| Zone 110c | 72 | 72 | Open |

As can be seen in Table 2, the current temperature value in zone 110*a* is below the set point, and thus, the HVAC system 120 is operating to increase the temperature in the zone 110*a* to the set point. The conditioned air would flow into the zone 110*a* as the damper status is open. For zones 110*b* and 110*c*, the dampers are closed as there is no requirement to further heat the zones.

TABLE 2

| | Set Point | Current Temperature Value | Damper Status |
|---|---|---|---|
| Zone 110a | 70 | 68 | Open |
| Zone 110b | 70 | 70 | Closed |
| Zone 110c | 72 | 72 | Closed |

As can be seen in Table 3, at time T1, the current temperature value in zone 110*a* is below the set point, and thus, the HVAC system 120 is operating to increase the temperature in the zone 110*a* to the set point. Further, the current temperature value in zone 110*c* is above the set point but below the first threshold value (78° F.). In zone 110*c*, there is a hardware malfunction with the associated damper 143-3 because of the reverse wiring of the damper 143-3. As the damper is wired backward, the damper status may be noted as closed, however, the damper 143-3 may be open in the zone 110*c*. As the damper 143-3 in zone 110*c* is open, the zone 110*c* is being heated above the set point.

At time T2, the current temperature value in zone 110*a* is still below the set point and the HVAC system is operating to increase the temperature in the zone 110*a* to the set point. However, because the damper 143-3 in zone 110*c* is open, the zone 110*c* is being heated as well. At T2, the temperature of the zone 110*c* reaches 78° F., i.e., the first threshold value. The HVAC system 120 may be unable to close the damper because of the reverse wiring.

At time T3, the current temperature value in zone 110*a* is still below the set point and the HVAC system 120 is operating to increase the temperature in the zone 110*a* to the set point. The damper 143-3 in zone 110*c* is still open and the zone 110*c* is heated to reach a temperature of 90° F. which is the second threshold value. When the temperature in zone 110*c* reaches the second threshold value, the HVAC system ceases the heating operation in all the zones and shuts down the HVAC equipment 140. An alert notification may be displayed on a GUI associated with the HVAC system 120, the alert notification may comprise details related to possible errors and malfunctions. The user may thus view the notification and may take necessary step to resolve the errors and malfunctions.

TABLE 3

| | | Set Point | Current Temperature Value | Damper Status |
|---|---|---|---|---|
| T1 | Zone 110a | 70 | 64 | Open |
| | Zone 110b | 70 | 70 | Closed |
| | Zone 110c | 70 | 74 | Closed (open) |
| T2 | Zone 110a | 70 | 65 | Open |
| | Zone 110b | 70 | 70 | Closed |
| | Zone 110c | 70 | 78 | Closed (open) |
| T3 | Zone 110a | 70 | 69 | Open |
| | Zone 110b | 70 | 70 | Closed |
| | Zone 110c | 70 | 90 | Closed (open) |

Referring to Table 4, the HVAC system 120 may be facing a software malfunction and may inaccurately process user inputs for heating the indoor environment 110. For instance, the HVAC system 120 may process user inputs to determine that heating of the zones 110*a* and 110*b* is required. At time T1, the current temperature value at zone 110*b* is above the set point, however, the HVAC system 120 may not determine that the damper for zone 110*b* is to be closed. Because of the software malfunction, the HVAC system 120 may determine the damper 143-2 for zone 110*b* to be closed even though the damper 143-2 is open.

At time T2, the HVAC system 120 is heating zone 110*a* as the current temperature of zone 110*a* is below the set point. However, for zone 110*b*, the current temperature value reaches 75° F. as the damper is open. At time T3, the current temperature value at zone 110*b* reaches the first threshold value, i.e., 78° F. The first control action is thus triggered and the HVAC system 120, in particular, the control device 130 of the HVAC system 120 closes the damper 143-2 for zone 110*b*. Additionally, an alert notification may be generated to alert a user regarding possible errors and malfunctions. Further, the current temperature value at zone 110*c* may be increased because of residual heat from other areas of the indoor environment 110.

At time T4, as the damper 143-2 for zone 110*b* is closed, the current temperature value falls closer to the set point. In absence of the first control action being triggered, the current temperature value for zone 110*b* may be raised further. At time T5, as the damper 143-2 for zone 110*b* is closed, the current temperature value continues to fall closer to the set point and the HVAC system 120 may operate normally.

TABLE 4

| | | Set Point | Current Temperature Value | Damper Status |
|---|---|---|---|---|
| T1 | Zone 110a | 70 | 61 | Open |
| | Zone 110b | 70 | 71 | Open (Closed) |
| | Zone 110c | 70 | 70 | Closed |
| T2 | Zone 110a | 70 | 65 | Open |
| | Zone 110b | 70 | 75 | Open (Closed) |
| | Zone 110c | 70 | 71 | Closed |
| T3 | Zone 110a | 70 | 67 | Open |
| | Zone 110b | 70 | 78 | Closed |
| | Zone 110c | 70 | 72 | Closed |
| T4 | Zone 110a | 70 | 69 | Open |
| | Zone 110b | 70 | 75 | Open (Closed) |
| | Zone 110c | 70 | 70 | Closed |
| T5 | Zone 110a | 70 | 70 | Open |
| | Zone 110b | 70 | 71 | Closed |
| | Zone 110c | 70 | 70 | Closed |

Figure 3:
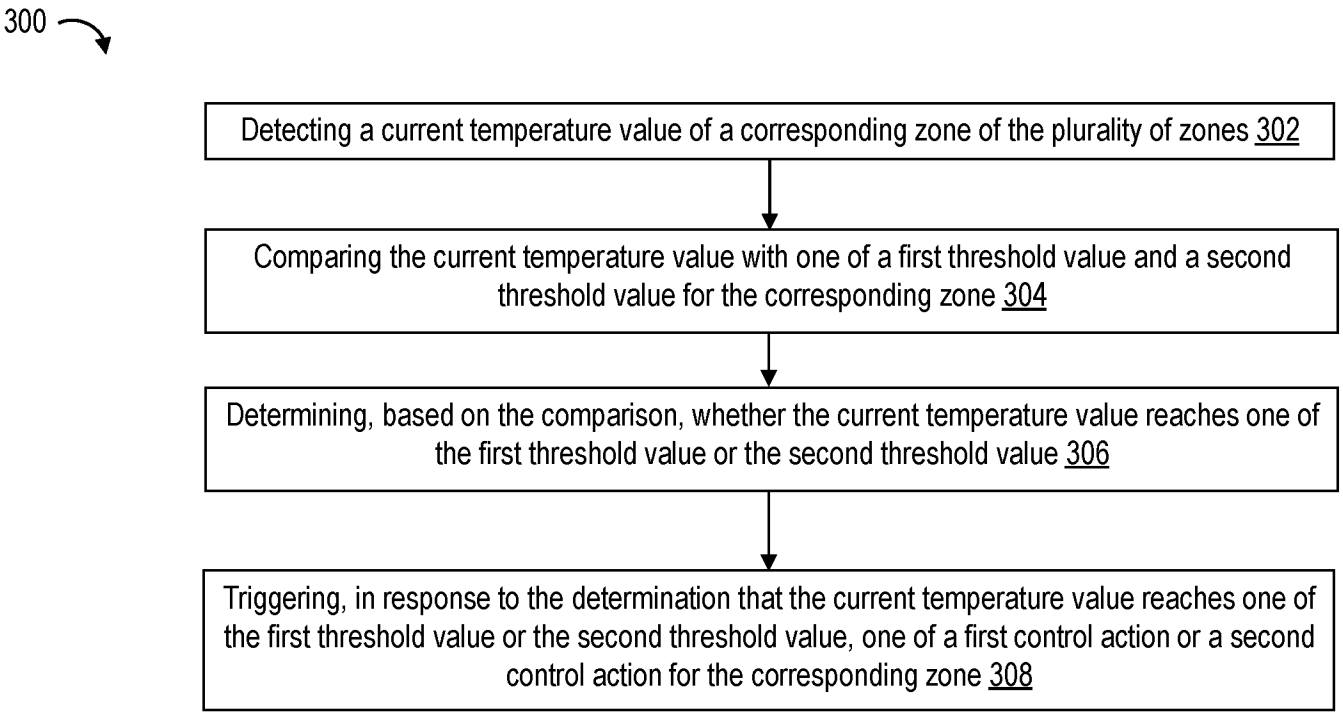
FIG. 3 illustrates a process flow chart depicting a method for managing temperature control in an indoor environment.

FIG. 3 illustrates a process flow depicting a method 300 for managing temperature control in an indoor environment (e.g., indoor environment 110) by an HVAC system (e.g., the HVAC system 120). The method 300 may be performed for each of the plurality of zones 110*a* to 110*c* such that the temperature in each of the plurality of zones 110*a* to 110*c* within the indoor environment 110 can be controlled.

At step 302, the method 300 comprises detecting the current temperature value of the corresponding zone of the plurality of zones 110*a* to 110*c*. In an embodiment, the current temperature value of the corresponding zone may be detected by the temperature sensors 141 of the HVAC system 120 that are installed within the corresponding zone of the plurality of zones 110*a* to 110*c*. In an embodiment, the user input corresponding to one of the heating or cooling of the corresponding zones may be received and the current temperature value of the corresponding zones may be detected based on the reception of the user input. In an embodiment, the current temperature value at the corresponding zone may be maintained within the set point range based on the received user input.

At step 304, the method 300 comprises comparing the current temperature value with one of the first threshold value and the second threshold value for the corresponding zone. In an embodiment, when the heating is performed, i.e., when the HVAC system 120 operates in the heating mode, the first threshold value may be greater than the corresponding set point range, and further, the second threshold value may be greater than the first threshold value. In an embodiment, when the cooling is performed, i.e., when the HVAC system 120 operates in the cooling mode, the first threshold value may be less than the corresponding set point range, and further, the second threshold value may be less than the first threshold value.

At step 306, the method 300 comprises determining, based on the comparison, whether the current temperature value reaches one of the first threshold value or the second threshold value.

At step 308, the method 300 comprises in response to the determination that the current temperature value reaches one of the first threshold value or the second threshold value, triggering one of the first control action or the second control action for the corresponding zone. The second threshold value is one of greater than or less than the first threshold value and a set point range for the corresponding zone when one of heating or cooling is being performed by the HVAC system 120.

Figure 4:
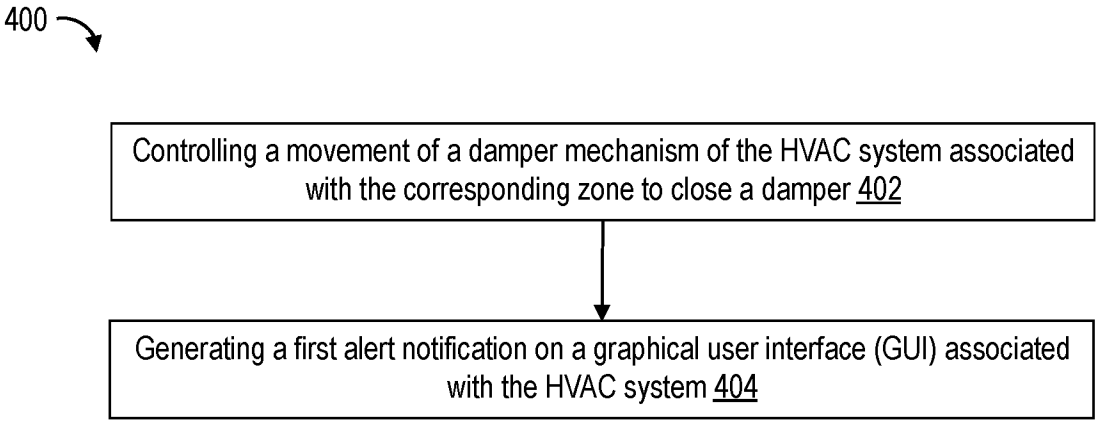
FIG. 4 illustrates a process flow chart depicting a method for triggering a first control action by the HVAC system.

FIG. 4 illustrates a process flow depicting a method 400 for triggering a first control action by the HVAC system 120.

At step 402, the method 400 comprises controlling the movement of the damper mechanism of the HVAC system 120 associated with the corresponding zone to close the damper. As described above, each of the plurality of zone may be associated with the damper, for example, one of the dampers 143-1 to 143-3, and for the corresponding zone, the damper (143-1, 143-2, or 143-3) may be closed to restrict the flow of conditioned air into the corresponding zone when the current temperature value of the corresponding zone reaches the first threshold value.

At step 404, the method 400 comprises generating the first alert notification on the GUI associated with the HVAC system 120. The first alert notification may be indicative of a malfunction within the corresponding zone where the current temperature value reaches the first threshold value.

Figure 5:
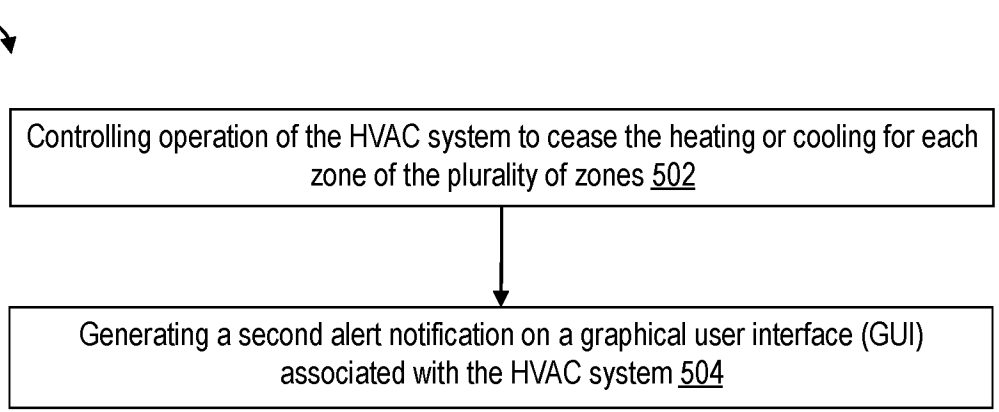
FIG. 5 illustrates a process flow chart depicting a method for triggering a second control action by the HVAC system.

FIG. 5 illustrates a process flow depicting a method 500 for triggering the second control action by the HVAC system 120.

At step 502, the method 500 comprises controlling the operation of the HVAC system 120 to cease the heating or cooling for each zone of the plurality of zones 110*a* to 110*c* within the indoor environment 110. That is when the current temperature value of the corresponding zone reaches the second threshold value, the HVAC system 120 may be controlled to cease the ongoing heating or cooling in all of the zones in the indoor environment 110.

At step 504, the method 500 comprises generating the second alert notification on the GUI associated with the HVAC system 120. The second alert notification may be indicative of a malfunction within the corresponding zone where the current temperature value reaches the second threshold value.

While the above steps of FIGS. 3-5 are shown and described in a particular sequence, the steps may occur in variations to the sequence in accordance with various embodiments of the disclosure. Further, a detailed description related to the various steps of FIGS. 3-5 is already covered in the description related to FIGS. 1-2 and is omitted herein for the sake of brevity.

The disclosure provides a HVAC system that continuously references temperature set points and thresholds for various areas within the indoor environment and compares the actual temperature of the areas with the set points and thresholds. The HVAC system triggers control actions based on comparison of the actual temperature readings with the set points and thresholds. In case the temperature within one or more areas (zones) of the indoor environment is reaching unsafe levels, the HVAC system may prevent escalation of the temperatures. Further, in extreme conditions, the HVAC system may cease the entire heating or cooling operation. Moreover, the HVAC system may alter the associated users so that corrective measures may be taken to resolve any errors and malfunctions. The indoor environment is thus maintained in safe living conditions.

As would be apparent to a person in the art, various working modifications may be made to the methods disclosed herein in order to implement the inventive concept as taught herein.

Moreover, the actions of any flow diagram need not be implemented in the order shown; nor do all of the acts necessarily need to be performed. Also, those acts that are not dependent on other acts may be performed in parallel with the other acts.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

While specific language has been used to describe the subject matter, any limitations arising on account thereto, are not intended. As would be apparent to a person in the art, various working modifications may be made to the method in order to implement the inventive concept as taught herein. The drawings and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment.

We claim:

1. A method for managing temperature control in an indoor environment by a Heating Ventilation and Air Conditioning (HVAC) system, the indoor environment includes a plurality of zones, wherein, for each of the plurality of zones, the method comprises:

detecting a current temperature value of a corresponding zone of the plurality of zones;

comparing the current temperature value with one of a first threshold value and a second threshold value for the corresponding zone;

determining, based on the comparison, whether the current temperature value reaches one of the first threshold value or the second threshold value; and in response to the determination that the current temperature value reaches one of the first threshold value or the second threshold value, triggering one of a first control action or a second control action for the corresponding zone, wherein the second threshold value is one of greater than or less than the first threshold value and a set point range for the corresponding zone when one of heating or cooling is being performed by the HVAC system, and wherein when the heating is performed, the first threshold value is greater than the corresponding set point range, and the second threshold value is greater than the first threshold value.

2. The method of claim 1, wherein when the cooling is performed, the first threshold value is less than the corresponding set point range, and the second threshold value is less than the first threshold value.

3. The method of claim 1, comprising:

receiving, from a user associated with the corresponding zone, a user input corresponding to one of heating or cooling of the corresponding zone, wherein the current temperature value of the corresponding zone is detected based on the reception of the user input.

4. The method of claim 1, further comprising:

maintaining, at the corresponding zone, the current temperature value within the set point range based on a received user input.

5. The method of claim 1, wherein, triggering the first control action for the corresponding zone comprises:

controlling a movement of a damper mechanism of the HVAC system associated with the corresponding zone to close a damper.

6. The method of claim 1, wherein, when the first control action is triggered, the method comprises:

generating a first alert notification on a graphical user interface (GUI) associated with the HVAC system, wherein the first alert notification is indicative of a malfunction within the corresponding zone.

7. The method of claim 1, wherein triggering the second control action for the corresponding zone comprises:

controlling operation of the HVAC system to cease the heating or cooling for each zone of the plurality of zones; and generating a second alert notification on a graphical user interface (GUI) associated with the HVAC system, wherein the second alert notification is indicative of a malfunction within the corresponding zone.

8. The method of claim 1, wherein the current temperature value of the corresponding zone is detected by one or more temperature sensors of the HVAC system, and the one or more temperature sensors are installed within the corresponding zone of the plurality of zones.

9. A Heating Ventilation and Air Conditioning (HVAC) system to manage temperature control in an indoor environment, the indoor environment includes a plurality of zones, the HVAC system comprising:

at least one HVAC equipment, and at least one control device communicatively connected with the at least one HVAC equipment, the at least one control device comprising one or more processors configured to, for each of the plurality of zones:

detect a current temperature value of a corresponding zone of the plurality of zones;

compare the current temperature value with one of a first threshold value and a second threshold value for the corresponding zone;

determine, based on the comparison, whether the current temperature value reaches one of the first threshold value or the second threshold value; and in response to the determination that the current temperature value reaches one of the first threshold value or the second threshold value, trigger one of a first control action or a second control action for the corresponding zone, wherein the second threshold value is one of greater than or less than the first threshold value and a set point range for the corresponding zone when one of heating or cooling is being performed by the HVAC system, and wherein when the heating is performed, the first threshold value is greater than the corresponding set point range, and the second threshold value is greater than the first threshold value.

10. The HVAC system of claim 9, wherein when the cooling is performed, the first threshold value is less than the corresponding set point range, and the second threshold value is less than the first threshold value.

11. The HVAC system of claim 9, wherein the one or more processors are configured to:

receive, from a user associated with the corresponding zone, a user input corresponding to one of heating or cooling of the corresponding zone, wherein the current temperature value of the corresponding zone is detected based on the reception of the user input.

12. The HVAC system of claim 9, wherein the one or more processors are configured to:

maintain, at the corresponding zone, the current temperature value within the set point range based on a received user input.

13. The HVAC system of claim 9, wherein, to trigger the first control action for the corresponding zone, the one or more processors are configured to:

control a movement of a damper mechanism of the HVAC system associated with the corresponding zone to close a damper.

14. The HVAC system of claim 9, wherein, when the first control action is triggered, the one or more processors are configured to:

generate a first alert notification on a graphical user interface (GUI) associated with the HVAC system, wherein the first alert notification is indicative of a malfunction within the corresponding zone.

15. The HVAC system of claim 9, wherein, to trigger the second control action for the corresponding zone, the one or more processors are configured to:

control operation of the HVAC system to cease the heating or cooling for each zone of the plurality of zones; and generate a second alert notification on a graphical user interface (GUI) associated with the HVAC system, wherein the second alert notification is indicative of a malfunction within the corresponding zone.

16. The HVAC system of claim 9, wherein the current temperature value of the corresponding zone is detected by one or more temperature sensors of the HVAC system, and the one or more temperature sensors are installed within the corresponding zone of the plurality of zones.

17. A method for managing temperature control in an indoor environment by a Heating Ventilation and Air Conditioning (HVAC) system, the indoor environment includes a plurality of zones, wherein, for each of the plurality of zones, the method comprises:

detecting a current temperature value of a corresponding zone of the plurality of zones;

comparing the current temperature value with one of a first threshold value and a second threshold value for the corresponding zone;

determining, based on the comparison, whether the current temperature value reaches one of the first threshold value or the second threshold value; and in response to the determination that the current temperature value reaches one of the first threshold value or the second threshold value, triggering one of a first control action or a second control action for the corresponding zone, wherein the second threshold value is one of greater than or less than the first threshold value and a set point range for the corresponding zone when one of heating or cooling is being performed by the HVAC system, and wherein when the cooling is performed, the first threshold value is less than the corresponding set point range, and the second threshold value is less than the first threshold value.

18. A Heating Ventilation and Air Conditioning (HVAC) system to manage temperature control in an indoor environment, the indoor environment includes a plurality of zones, the HVAC system comprising:

at least one HVAC equipment, and at least one control device communicatively connected with the at least one HVAC equipment, the at least one control device comprising one or more processors configured to, for each of the plurality of zones:

detect a current temperature value of a corresponding zone of the plurality of zones;

compare the current temperature value with one of a first threshold value and a second threshold value for the corresponding zone;

determine, based on the comparison, whether the current temperature value reaches one of the first threshold value or the second threshold value; and in response to the determination that the current temperature value reaches one of the first threshold value or the second threshold value, trigger one of a first control action or a second control action for the corresponding zone, wherein the second threshold value is one of greater than or less than the first threshold value and a set point range for the corresponding zone when one of heating or cooling is being performed by the HVAC system, and wherein when the cooling is performed, the first threshold value is less than the corresponding set point range, and the second threshold value is less than the first threshold value.

* * * * *